US005815135A

United States Patent [19]

Yui et al.

[11] Patent Number: 5,815,135

[45] Date of Patent: Sep. 29, 1998

[54] DISPLAY CONTROL APPARATUS

[75] Inventors: Hideaki Yui, Kawasaki; Katsuhiro Miyamoto, Isehara, both of Japan

[73] Assignee: Canon Kabushiki Kaisha, Tokyo, Japan

[21] Appl. No.: 625,069

[22] Filed: Mar. 29, 1996

[30] Foreign Application Priority Data

Apr. 5, 1995 [JP] Japan ..... 7-080412

[51] Int. Cl.[6] ..... G09G 3/36

[52] U.S. Cl. ..... 345/97; 345/3

[58] Field of Search ..... 345/3, 87, 88, 345/89, 97, 100

[56] References Cited

U.S. PATENT DOCUMENTS 5,353,041 10/1994 Miyamoto et al. ..... 345/97
5,420,603 5/1995 Tsuboyama et al. ..... 345/87
5,576,731 11/1996 Whitby et al. ..... 345/100

FOREIGN PATENT DOCUMENTS 0 608 053 7/1994 European Pat. Off. .

*Primary Examiner*—Matthew Luu
*Attorney, Agent, or Firm*—Fitzpatrick, Cella, Harper & Scinto

[57] ABSTRACT

A motion detector detects a line where change of image data has occurred, and a line selector selects the line where display is to be updated, based on the motion detection. A γ converter performs γ conversion on the input data with a predetermined γ value and obtains converted data. A memory controller partially updates display on a display device with display data of the line selected by the line selector, among display data suitable to the display device generated based on the converted data. If the γ value of the γ converter is switched, the display data generated based on the converted data obtained from γ conversion after the switchover of the γ value display on the display device is updated for at least one frame.

36 Claims, 7 Drawing Sheets

DISPLAY CONTROL APPARATUS

BACKGROUND OF THE INVENTION

This invention relates to a display control apparatus and method, and a display apparatus using the display control apparatus.

Generally, a CRT video output signal from a host computer is transferred to a CRT display or a liquid crystal display such as a TFT synchronized with the transfer speed and scanning of all the scan lines is made for each frame, in accordance with an interlaced scanning method. In such display device, even when a γ value is rewritten, the processing is always completed within one frame, thus data display can be performed with no trouble.

In a slow-response FLC (ferroelectric liquid crystal) display or the like where only a frequency component lower than the frame frequency component can be drawn, to make up with the transfer speed, a so-called partial rewriting method is employed to update display of only scan line(s) where motion has been detected. This seemingly ensures a frame frequency corresponding to the CRT video output signal. Generally, a γ converter is provided at an arbitrary position in an image processing system as a data converter for input data.

However, in the system as described above, where a CRT video output signal is converted into a signal appropriate to an FLC display having maintainability in the liquid crystal itself, if γ-value switchover function based on user's selection is provided, the following problem occurs.

To perform the partial rewriting as described above, a motion detector is necessary for detecting a line where motion has occurred. Even if data conversion processing such as γ conversion is changed (γ value for γ conversion is changed) while drawing is performed on data that needs continuous partial rewriting, only the line where motion has been detected by the motion detector is rewritten in the partial-rewrite processing. This partial rewriting produces a frame period where line data before the γ-value switchover and data after the γ-value switchover are mixedly displayed. Accordingly, display status is degraded.

Further, if the motion detector is provided after the γ converter, the operation of the γ converter itself might be regarded as a part of the motion. When the γ converter converts image data, the amount of change with respect to the input image data changes after the γ conversion, thus causing degradation of motion-detection efficiency.

SUMMARY OF THE INVENTION

The present invention has been made in consideration of the above problems, and has its object to provide a display control apparatus and method and display apparatus using the display control apparatus which, if the input-data conversion is switched during display control by partial-rewrite processing, prevents mixed display of data before the switchover of input-data conversion and data after the switchover of input-data conversion, within one frame.

Further, another object of the present invention is to enable stable detection of a changed position in partial-rewrite processing, without receiving any influence due to input-data conversion.

Further, another object of the present invention is to provide a display control apparatus and method corresponding to various video signals and display devices, by adopting γ-value switchable γ conversion as a variable input-data conversion processing.

Further, another object of the present invention is to prevent occurrence of inappropriate data upon switching input-data conversion processing so as to realize switchover of conversion processing without displaying unnatural images.

Further, another object of the present invention is to enable manual switching of the input-data conversion processing so that a user can arbitrarily set a conversion processing while observing a display screen.

Further, another object of the present invention is to enable switchover of input-data conversion processing based on an external signal. As the conversion processing is switched by the external signal, a user need not perform-.manual operation such as setting of conversion processing. For example, appropriate γ conversion is automatically made by inputting a γ value used by a video interface attached to an external device which supplies input data, and setting the conversion processing so as to perform appropriate γ conversion based on the γ value, thus offloading user's operation.

Further, another object of the present invention is to enable changing input-data conversion processing based on a signal from a connected display device so as to easily set conversion processing corresponding to the display device. For example, an appropriate γ value can be automatically set even when the display device is changed, by inputting a γ value, appropriate to the connected display device, for switching the γ value for the input-data conversion.

Further, another object of the present invention is to provide a display apparatus having a display device for displaying data outputted from a display control apparatus according to the present invention.

Further, another object of the present invention is to perform display control of an FLC panel which has display-status maintainability and which is appropriate to partial rewrite control.

Other features and advantages of the present invention will be apparent from the following description taken in conjunction with the accompanying drawings, in which like reference characters designate the same name or similar parts throughout the figures thereof.

BRIEF DESCRIPTION OF THE DRAWINGS

The accompanying drawings, which are incorporated in and constitute a part of the specification, illustrate embodiments of the invention and, together with the description, serve to explain the principles of the invention.

DETAILED DESCRIPTION OF THE PREFERRED EMBODIMENTS

Preferred embodiments of the present invention will now be described in detail in accordance with the accompanying drawings.

In the following embodiments, γ conversion is adopted as input-data conversion, and a case where γ-value switchover for the γ conversion is performed while partial rewriting of display data is performed by output device will be described. In this case, display control is made such that all the data for at least one frame are newly written after γ-value switchover, regardless of the detection of a change of display contents between frames by detection device. This prevents inconvenience of mixed display of display data before γ-value switchover and display data after the γ-value switchover.

Further, according to the following embodiments, the input to the γ converter and that to the motion detector device are the same. This improves motion detection efficiency.

[First Embodiment]

Figure 1:
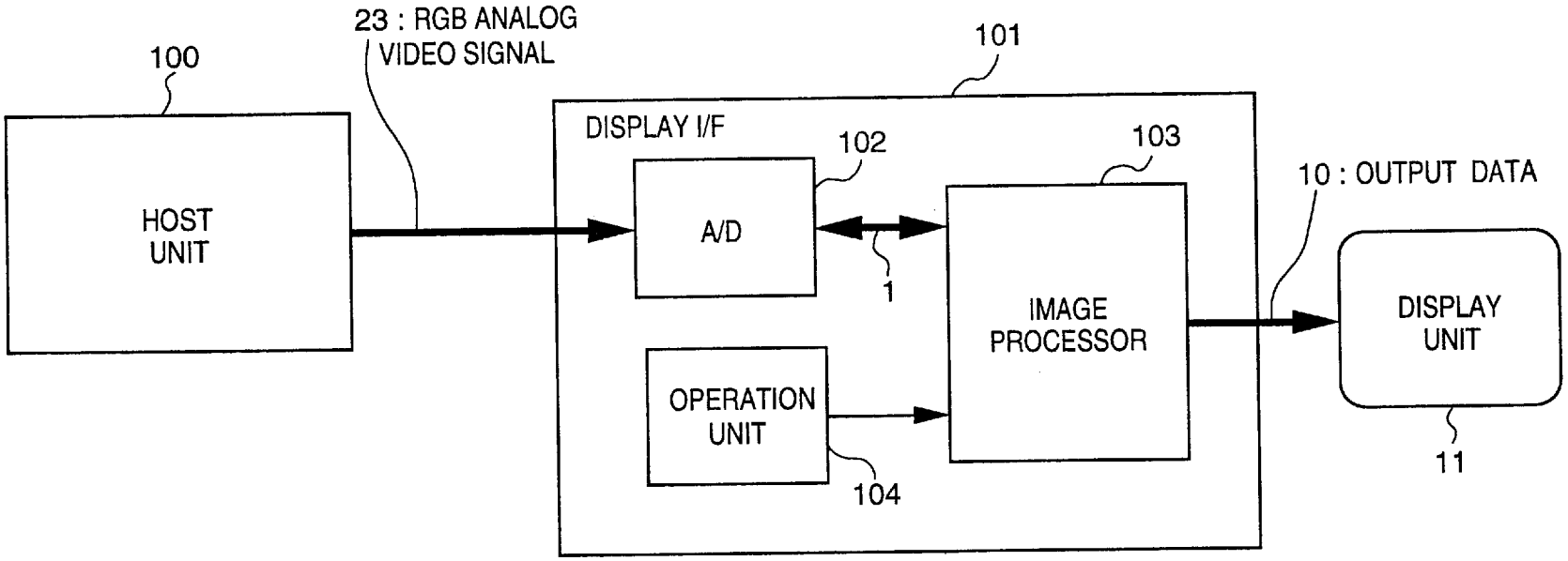
FIG. 1 is a block diagram showing the construction of an information processing apparatus according to a first embodiment.

FIG. 1 is a block diagram showing the construction of an information processing apparatus according to a first embodiment of the present invention. In FIG. 1, reference numeral 100 denotes a host unit 100 such as a personal computer. The host unit 100 outputs an RGB analog video signal 23 under the control of its internal CPU. Numeral 101 denotes a display device interface (I/F) which converts the input RGB analog video signal 23 into a signal appropriate to be displayed by a display device 11. In this embodiment, an FLC display is used as the display device 11. The display device I/F 101 has an A/D converter 102 for converting the input RGB analog video signal 23 into digital input data 1. Numeral 103 denotes an image processor which performs processing such as γ correction and partial-rewrite processing on the input data 1, and generates output data 10 suitable to the display device 11. The display device 11 performs image display in accordance with the output data 11. Numeral 104 denotes an operation panel for various operation-inputs by a user.

Figure 2:
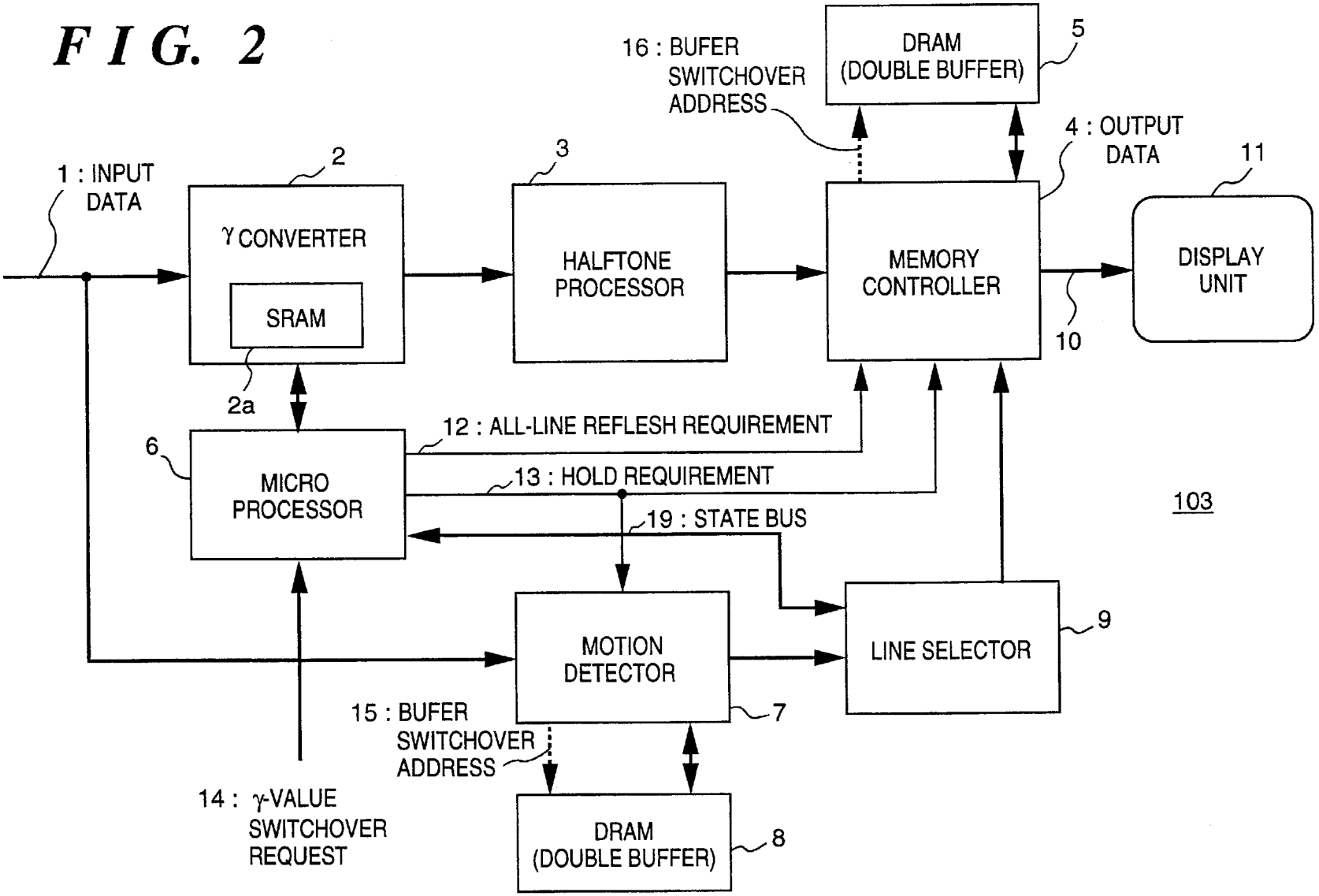
FIG. 2 is a block diagram showing the construction of an image processor 103 in FIG. 1.

FIG. 2 is a block diagram showing the construction of the image processor 103 in FIG. 1.

Numeral 1 denotes input data, which is RGB-input digital data obtained by A/D-converting a CRT video input signal; and 2, a γ converter having a SRAM 2*a* for storing a look-up table for γ conversion (hereinafter referred to as "γ-conversion table"). The γ converter 2 can rewrite the γ-conversion table stored in the SRAM 2*a* using inputs from a microprocessor 6. The γ converter 2 converts the input data 1 into address data of the SRAM 2*a*, reads data after the γ conversion corresponding to the input data 1, and outputs the read data to a halftone processor 3.

The halftone processor 3 performs pseudo full-color processing using conversion of the γ output into appropriate color space to the FLC display, error diffusion or dither processing. The conversion of the γ output to appropriate color space to the FLC display is, e.g., in a case where image input data of the halftone processor has color information which the FLC display cannot display, the data is converted to the closest color data around a boundary of the color space which can be displayed by the FLC display (so-called color-space clipping processing). The converted image data is stored into one of two buffers of a DRAM (hereinafter referred to as "double buffer") 5 by a memory controller 4.

On the other hand, the input data 1 inputted into the γ converter 2 is also inputted into a motion detector 7 which detects change of motion in each line by comparing Nth frame data with previous (N−1)th frame data. At this time, the (N−1)th frame data is stored in one of two buffers of a DRAM (hereinafter referred to as "double buffer") 8, to be referred to in comparison with the Nth frame.

Numeral 9 denotes a line selector which determines line data to be read from one of the buffers of the double buffer 5 by the memory controller 4, in accordance with the amount of motion in each line detected by the motion detector 7. Numeral 10 denotes output data comprising of a line address of the selected line and data in a format suitable to the display device (FLC display in this embodiment) 11. Numeral 14 denotes a γ-value switchover request which is generated as a signal indicative of γ-value switchover code, and supplied to a microprocessor 6.

Next, image processing according to the present embodiment having the above construction will be described.

First, normal partial-rewrite processing will be described. The γ conversion is performed on the input data 1, in accordance with the initial γ-conversion table set in the SRAM 2*a* of the γ converter 2. The processed data is passed through the halftone processor 3, and stored into a buffer of the double buffer 5 under the control of the memory controller 4. At this time, the memory controller 4 generates a buffer switchover address 16 for controlling the writing into the double buffer 5.

Figure 3A:
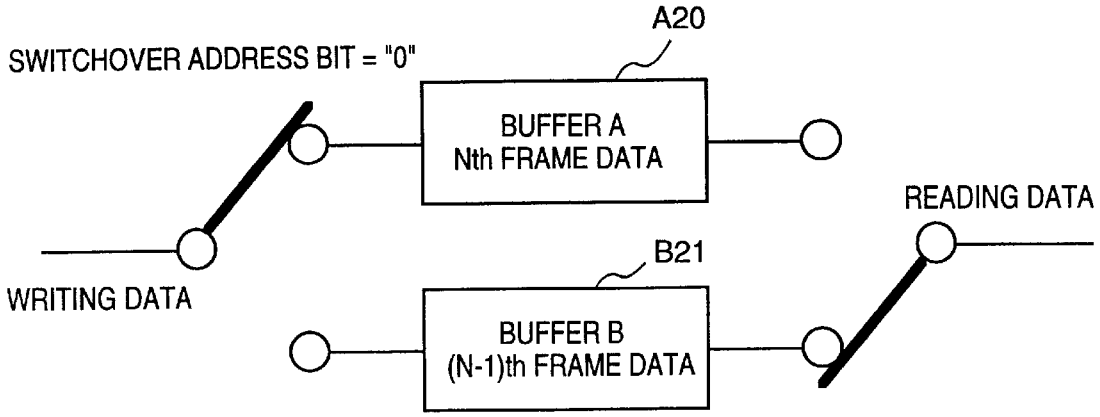
FIGS. 3A and 3B are block diagrams respectively showing the construction of a double buffer 5 in FIG. 2.
Figure 3B:
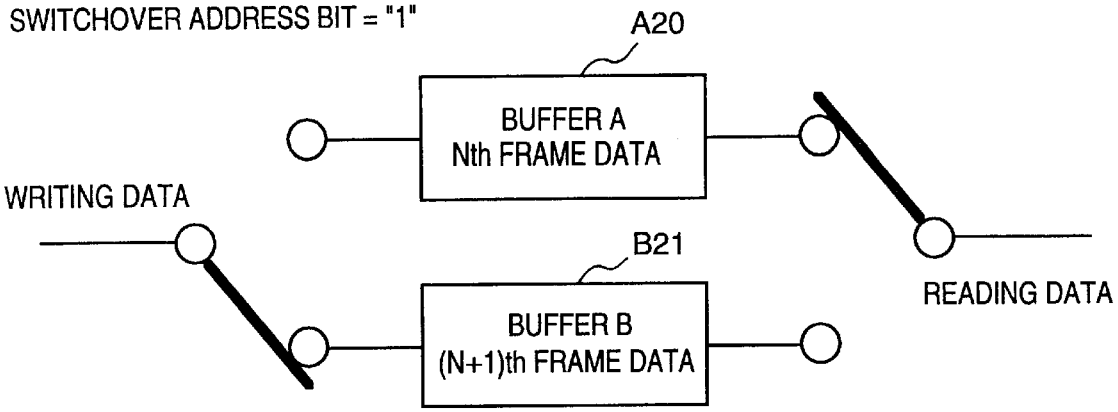

FIGS. 3A and 3B respectively show the construction of the double buffer 5. As shown in FIG. 3A, when the value of a switchover address bit is "0", the Nth frame data is stored into a buffer A20. On the other hand, the (N−1)th frame data is in a buffer B21 in standby status for reading for necessary line(s). When a new frame data is written, the value of the switchover address bit is "1", and switching of the buffers are made as shown in FIG. 3B. The buffer A20 is in standby status for reading, and (N+1)th frame data is written into the buffer B21. Thus, the memory controller controls writing/reading to/from the double buffer 5 such that writing and reading are switched by each frame data at the respective buffers.

Figure 4:
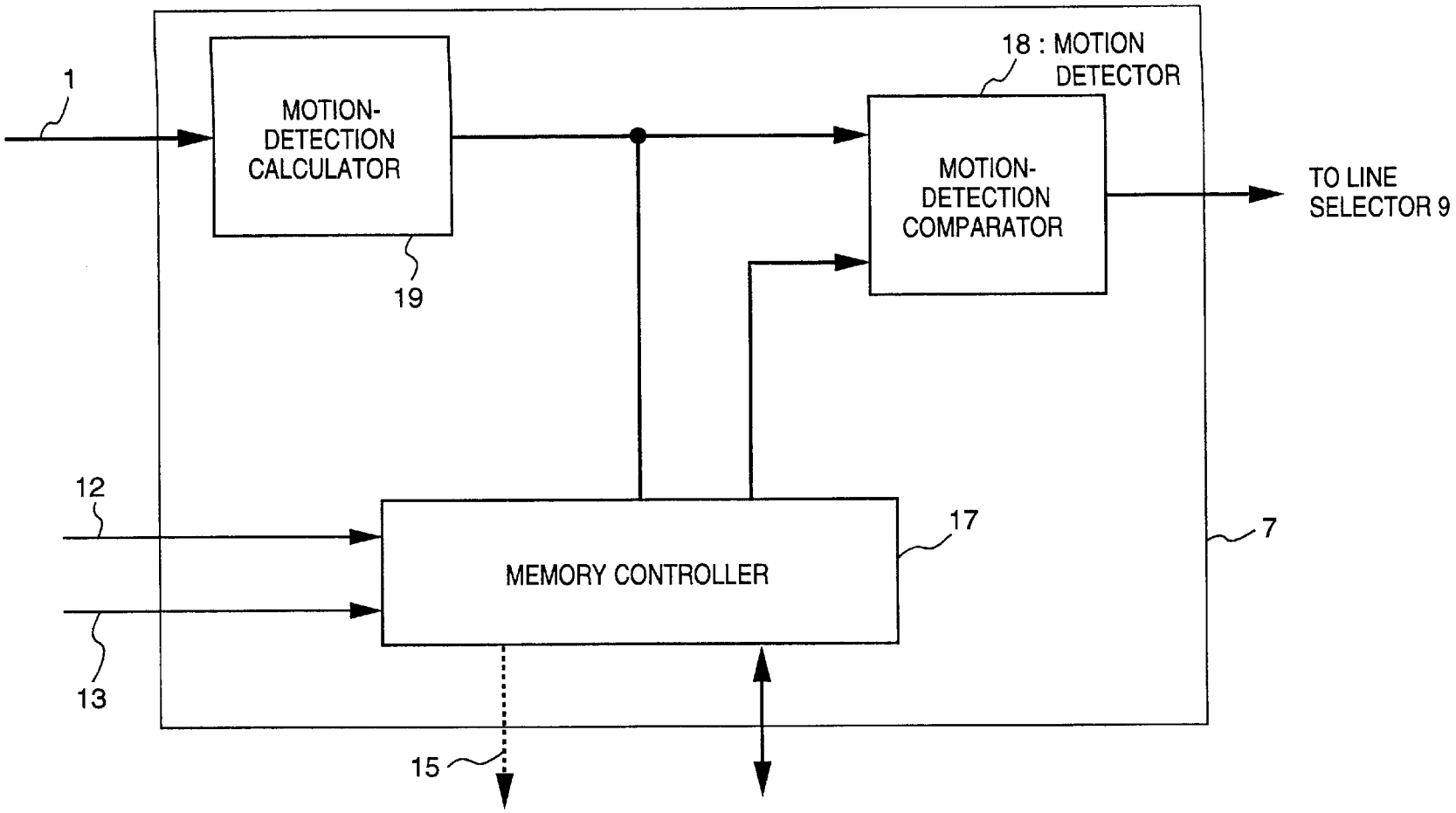
FIG. 4 is a block diagram showing the construction of a motion detector 7 in FIG. 2.

On the other hand, the motion detector 7, which performs processing based on the same frame period as that of writing of the input data 1 from the γ converter 2 into the double buffer 5, is connected to the double buffer 8 having the same structure as that of the double buffer 5. FIG. 4 shows the construction of the motion detector 7.

In FIG. 4, numeral 19 denotes a motion-detection calculator which interprets the signature (feature) of motion by each line with respect to the previous frame of the input data 1. More specifically, each line data is converted into signature data comprising of average motion correlation data and instant motion correlation data, and the signature data is stored one buffer of the double buffer 8 under the control of the memory controller 17.

On the other hand, the signature data is also inputted into a motion-detection comparator 18. The motion-detection comparator 18 compares the signature data inputted from the motion-detection calculator 19 with signature data of the previous frame data read by the memory controller 17 from the double buffer 8. In a case where the signature of the current processed frame data has been changed from that of the previous frame data, it is determined that motion has occurred. This series of processings is performed on all the scan lines, to detect motion in each scan line within one frame. The obtained motion detection information is transferred to a line selector 9.

Further, the memory controller 17 controls the double buffer 8 with a buffer switchover address 15, similar to the memory controller 4. The read/write control on the double buffer 8 and that on the double buffer 5 are synchronized so as to maintain coherency. To maintain coherency means to handle the same read/write frame at an instant, in the image processing system including the halftone processor and the image processing system including the motion detector.

The line selector 9 determines lines to be directed to partial-rewrite processing, based on the motion detection information in each line within one frame, inputted from the motion detector 7, and forwards the determination result to the memory controller 4 as line address information to be transferred to the display device 11. The memory controller 4 reads data from the buffer in reading-standby status of the double buffer 5, based on the address information. Thus, the memory controller 4 transfers the partial-rewrite address(es) and corresponding display data to the display device 11.

Note that the microprocessor 6 always monitors the status of the line selector 9 via a state bus 19, prepared for a case where the range of line address outputted by the line selector 9 exceeds a range of drawing for one frame in the display device 11 within a predetermined period. If the above status is found, the microprocessor 6 issues a hold requirement 13 to the memory controllers 4 and 17 so as to suspend the processing on the next frame until the processing on the current frame has been completed.

The normal partial-rewrite processing is performed in the sequence as described above.

Next, a case where γ-value switchover occurring during the above partial-rewrite processing will be described. In FIG. 2, when the γ-value switchover requirement 14 is transferred to the microprocessor 6, the microprocessor 6 recognizes the requirement and enters into γ-value switchover mode. The microprocessor 6 writes a γ-conversion table corresponding to the requirement, from a plurality of γ-conversion tables stored in its internal ROM, into the SRAM 2*a* of the γ converter 2.

Figure 5:
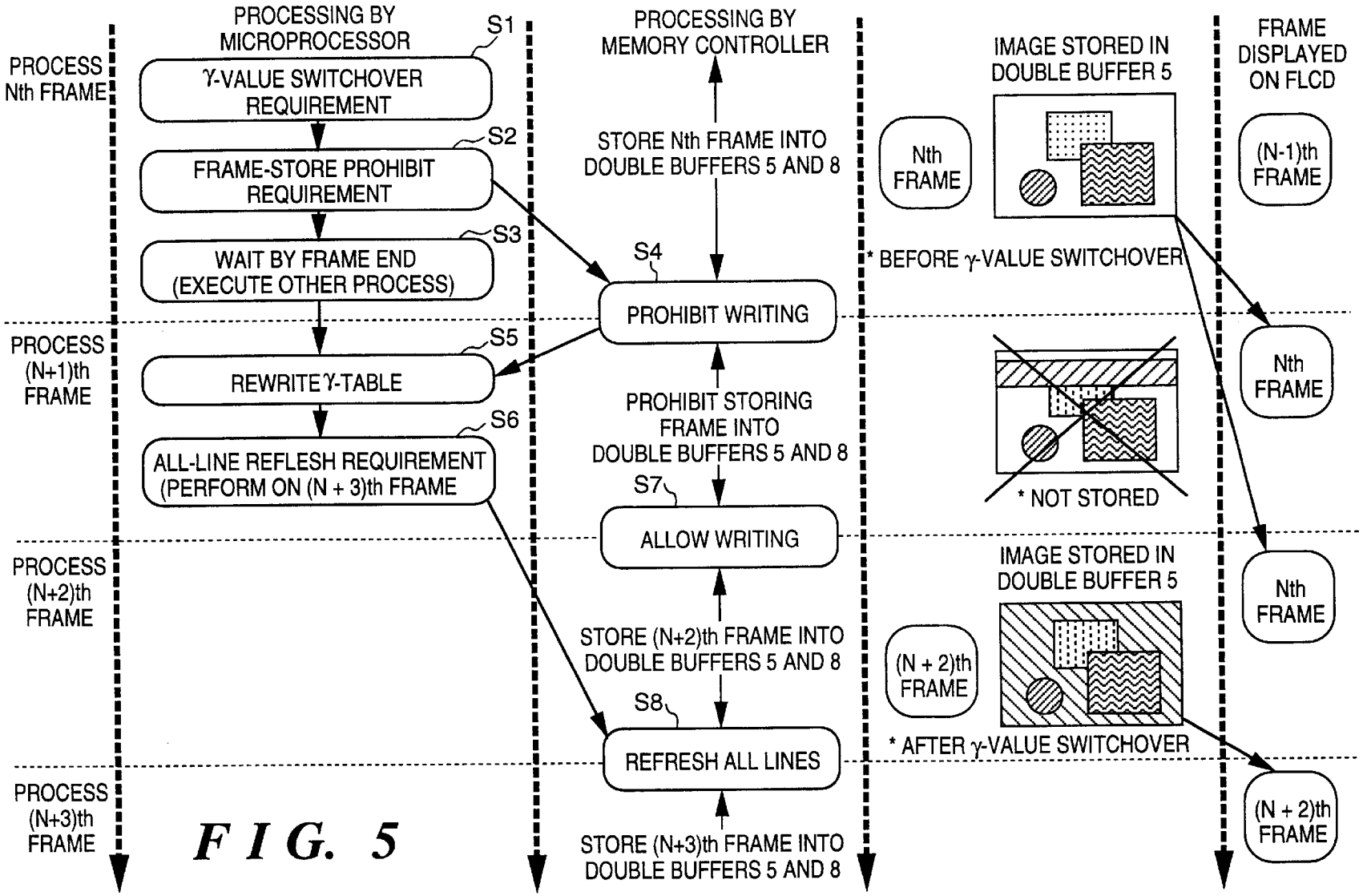
FIG. 5 is an explanatory view showing a γ-value switchover procedure according to the first embodiment.

The γ-value switchover algorithm according to the present embodiment (the substantial hardware operations in the partial-rewrite processing before γ-value switchover is as described above) will be described in detail with reference to FIG. 5 showing the γ-value switchover processing procedure.

(a) Current processed frame: Nth frame

The frame displayed on the display device 11 is the previous (N−1)th frame, and partial-rewrite processing is performed on only line(s) where motion has been detected. The Nth frame data before γ-value switchover is stored in one of the buffer selected for writing of the double buffer 5. If the microprocessor 6 detects the γ-value switchover requirement 14 (SI), it issues the hold requirement 13 shown in FIG. 2 to the memory controllers 4 and 17 (S2) as a frame-store prohibit requirement.

The memory controllers 4 and 17 respectively render writing of the next (N+1)-th frame data into the double buffers 5 and 8 into prohibited status (held status) (S4). Note that the microprocessor 6 at this time is in waiting status until the frame end of the Nth frame data (the rest period of processing the Nth frame data), and performs other processes (S3). Accordingly, the image data of the Nth frame is all written into the double buffer 5 and the signature data of the Nth frame data is all written into the double buffer 8.

(b) Current processed frame: (N+1)th frame

The microprocessor 6 updates the contents of the SRAM 2*a* of the γ converter 2 in accordance with the γ-value switchover requirement 14. (S5). As the writing to the double buffers 5 and 8 is prohibited, data storing for partial-rewrite processing is not made. Accordingly, inappropriate image output due to update of the γ-conversion table by the microprocessor 6 is ignored. The frame displayed on the display device 11 is the Nth frame, and partial-rewrite processing is performed on only line(s) where motion (change) has been detected during the processing on the Nth frame. Also, the microprocessor 6 generates an all-line refresh requirement signal 12 (FIG. 2) (S6) during this frame period. The all-line refresh requirement signal 12 is transferred to the memory controller 4, which begins preparation for reading data for all the lines from one buffer in reading-standby status of the double buffer 5.

(c) Current processed frame: (N+2)th frame

The prohibition of writing to the double buffers 5 and 8 is canceled. Note that in this example, the frame store prohibit requirement (hold requirement 13) is canceled during processing on the (N+1)th frame, then the memory controllers 4 and 17 cancel the writing prohibition status at the header of the next frame ((N+2)th frame), and the process returns to normal motion detection processing (S7). As a result, the (N+2)th frame data processed with a new γ-conversion table corresponding to a new γ-value is stored into one buffer in the writing-standby status of the double buffer 5. In this frame period, the Nth frame data is maintained on the display device 11 utilizing the feature of the FLC display, display-status maintainability.

(d) Current processed frame: (N+3)th frame

In this frame, in accordance with the all-line refresh requirement issued at step S6, the data of the all lines are transferred to the display device 11 (S8). In a case where this processing is not performed, if line(s) where motion (change) has been detected is a part of one frame during processing of the (N+2) frame, the Nth frame data before γ conversion and the (N+2)th frame data after the γ conversion are mixed in one frame, thus causing inappropriate display on the display device 11. To avoid such inconvenience, if the γ value has been switched, all the lines are refreshed so as to prevent inappropriate display of data before and after the γ-value switchover. In this manner, whenever γ-value switchover is performed during partial-rewrite processing, all the lines are refreshed, so that drawing on the display device can be done without inconvenience.

Note that if time necessary for updating display content by this all-line refreshment is longer than time for processing the next frame, process timing is adjusted by issuance of the hold requirement 13 as described above.

Further, in the construction of the present embodiment, as both the γ converter 2 and the motion detector 7 input the same input data 1, the problem of degradation of motion-detection efficiency due to γ-value switchover can be solved.

[Second Embodiment]

Figure 6:
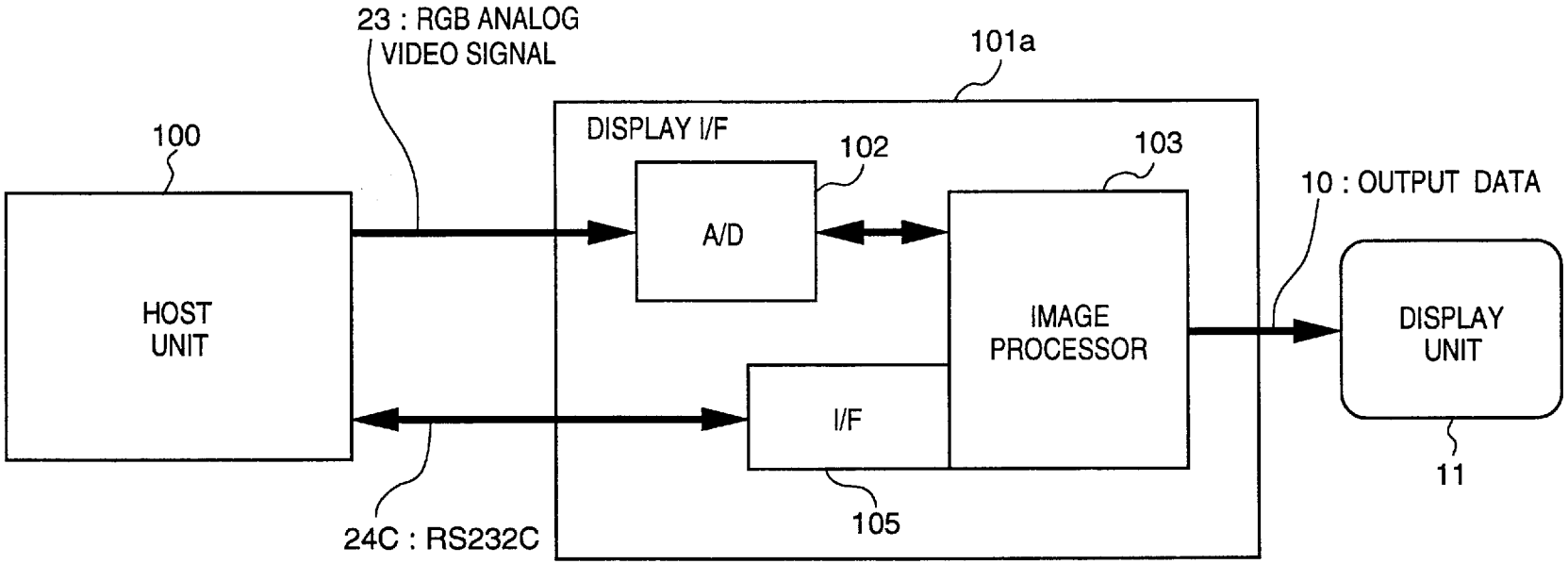
FIG. 6 is a block diagram showing the construction of the information processing apparatus according to a second embodiment.

In this embodiment, another method for transferring the γ-value switchover requirement 14 to the microprocessor 6 will be described. FIG. 6 is a block diagram showing the construction of the information processing apparatus according to the second embodiment. In FIG. 6, the present system construction is briefly divided into the host unit 100, a display device interface (I/F) 101*a* which receives the RGB analog video signal 23 from the host unit 100, and the display device 11 connected to the display device I/F 101*a*.

The display device I/F 101*a* comprises a system having the A/D converter 102 and the image processor 103 provided after the A/D converter 102 (FIG. 2).

In the first embodiment, the γ-value switchover requirement 14 is transferred to the microprocessor 6 by a user switch (operation panel 104) of the display device I/F 101.

In the second embodiment, data transferred by RS232C transmission from the host unit 100 is received via a serial interface (I/F) 105, and inputted into the image processor 103, thus signals other than the video signal can be transferred from the host unit 100 to the display device I/F 101*a*.

This construction enables to transfer γ-value designation which differs by each graphic card of the host unit 100, from the host unit 100 to the display device I/F 101*a*. The microprocessor 6 in the image processor 103 selects an inverse γ-conversion table suitable to the display device 11, based on the γ-value designation sent from the host unit 100. Note that the inverse γ-conversion table appropriate to the input γ-value designation is selected in accordance with a correspondence table pre-registered in the ROM (not shown) of the image processor 103. Then, the selected γ-conversion table is written into the SRAM 2*a* of the γ converter 2.

According to the second embodiment, a user does not have to manually adjust a γ value for each graphic card, and the host unit 100 automatically control the γ value to attain appropriate γ conversion. Note that the γ-value switchover process sequence during partial-rewrite processing is performed in the same manner as that of the first embodiment.

Note that as it is apparent from the above description, the host unit 100 detects the γ value of an attached graphic card and informs the display device I/F 101*a* of the detected γ value at predetermined timing. The predetermined timing means that detection is made at a point in time where the power is turned on, at a point in time where a γ-value notification requirement is received from the display device I/F 101*a* or the like.

The acquisition of γ value by the host unit 100 may be made by, e.g., preparing a table showing the correspondence between various graphic cards and γ values in the host computer, judging the type of an attached graphic card and referring to the table. Further, this type of table may be prepared on the display device I/F 101*a* side and receive information on the type of a graphic card from the host unit 100.

[Third Embodiment]

In the first embodiment, γ-value switchover is made by manual operation at the operation panel 104. In the second embodiment, γ-conversion table is automatically switched in accordance with a graphic card or the like by data communication (based on RS232C communication in the second embodiment) from the host unit 100. In this embodiment, in addition to the direct control from the host unit side in the second embodiment, automatic adjustment of the γ value can be made when the display device 11 is exchanged with a different type display device.

Figure 7:
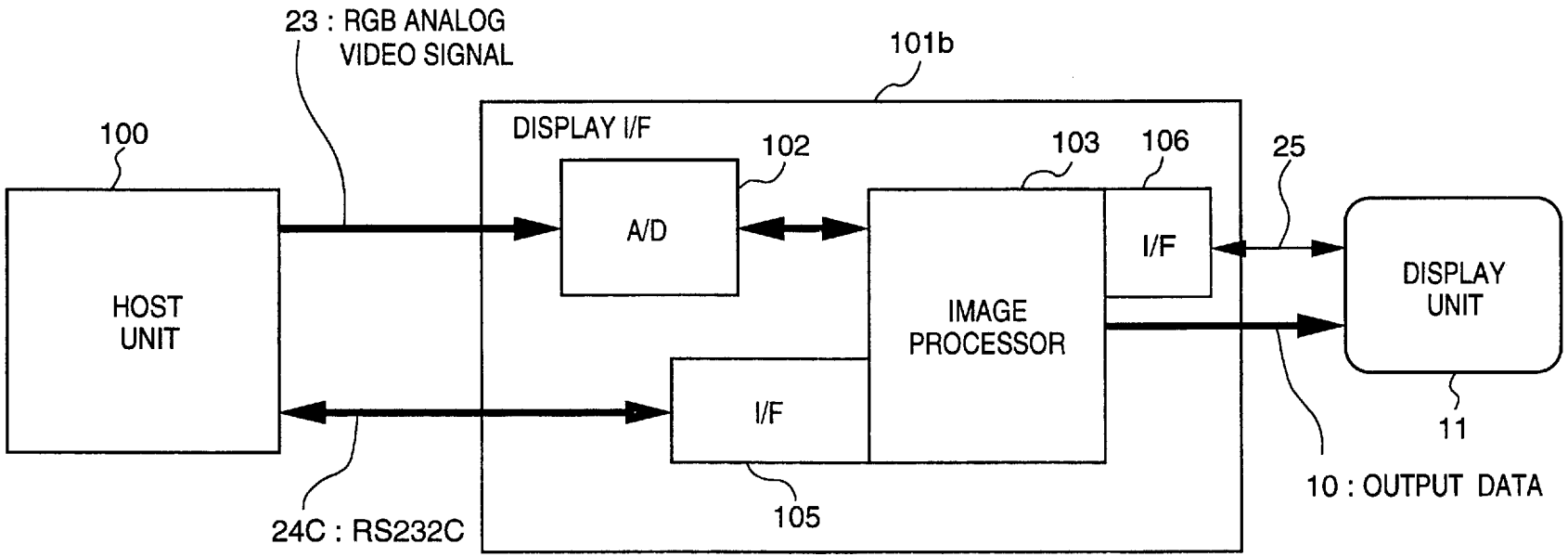
FIG. 7 is a block diagram showing the construction of the information processing apparatus according to a third embodiment.

FIG. 7 is a block diagram showing the construction of the information processing apparatus according to the third embodiment. Numeral 106 denotes an interface which receives a signal 25 designating a γ value corresponding to the display device 11 from the display device 11. In this embodiment, the interface 106 comprises, e.g., an RS2332C interface, for serial communication. The serial communication function between the image processor 103 and the display device 11 enables to transfer a γ-value designation signal from the display device 11 upon activation of the image processing apparatus.

On the other hand, the microprocessor 6 selects an inverse γ-conversion value appropriate to the graphic card attached to the host unit 100, based on the γ value sent from the host unit 100 and the γ value sent from the display device 11. Note that γ-conversion tables corresponding to various display devices and inverse γ-conversion tables corresponding to various graphic cards are registered in advance as reference tables in the ROM (not shown) in the image processor 103. In this manner, an appropriate γ-conversion table is written into the SRAM 2*a* of the γ converter 2.

Regarding the γ-conversion tables, tables for inverse γ conversion and tables for γ conversion may be independently prepared for converting input data, otherwise, integrated conversion tables, each including an inverse γ-conversion table and a γ-conversion table, corresponding to combinations of an inverse γ value and a γ value may be prepared for converting input data.

According to the third embodiment, a user's manual adjustment of γ value that differs based on the type of a graphic card and a display device can be offloaded. That is, automatic γ-conversion table selection can be made such that γ conversion appropriate to a currently-connected display device and a graphic card attached thereto is selected. Note that the process sequence of γ-value switchover during partial-rewrite processing is the same as that of the first embodiment.

Note that as it is apparent from the above description, the display device 11 informs a display device I/F 101*b* of a γ value appropriate to the display panel at predetermined timing. The predetermined timing means that informing is made at a point in time where the power is turned on, at a point in time where a γ-value notification requirement is received from the display device I/F 101*b* or the like.

Further, a table showing the correspondence between various display devices and γ values may be provided in the display device I/F 101*b* so that information on the type of the display device 11 is received from the display device 11, and a γ value is selected in accordance with the received information and the correspondence table.

As described above, according to the embodiments, partial-rewrite control is performed by the γ converter and the motion detector serially connected to each other with respect to input data. During the partial-rewrite control, if the γ value is switched over, all the lines of display data after the γ-value switchover are rewritten. This facilitates data updating for the whole frame image after the γ-value switchover, and prevents the inconvenience that display data before the γ-value switchover and display data after the γ-value switchover are mixedly exist in the same frame. Further, as the motion detector performs detection on input data before γ conversion, the detection is not influenced by the γ-conversion, thus degradation of motion-detection efficiency can be prevented.

Further, according to the.embodiments, the microprocessor prohibits storing of image data for one frame when the γ value is switched, which prevents writing of inappropriate data, caused by the γ-value switchover, into the buffer. Thus disturbance of drawing on the display device upon the γ-value switchover can be prevented.

Further, γ-value switchover on the display device side can be made from the host unit side (the second embodiment), and means for obtaining γ-value information by each type of display device is provided (the third embodiment), a user's manual adjustment of an inverse γ value and a γ value, in correspondence with the γ value of a graphic card attached to the host unit and the characteristic of the display device, can be offloaded. This provides a user-friendly colormanagement environment.

Further, in the above embodiments, an FLC display is employed as the display device 11, however the display device 11 is not limited to the FLC display. Any display device is acceptable so far as it has a display-frame frequency at a slower drawing speed than an input-frame frequency.

As described above, according to the present invention, in a case where input-data conversion is switched while display control by partial-rewrite processing is performed, the mixed display of data before the input-data conversion switchover and data after the input-data conversion switchover within one frame can be prevented.

Note that the object of the present invention can be also achieved by providing a storage medium storing program codes for performing the aforesaid processes to a system or an apparatus, reading the program codes with a computer (e.g., CPU, MPU) of the system or apparatus from the storage medium, then executing the program.

In this case, the program codes read from the storage medium realize the functions according to the embodiments, and the storage medium storing the program codes constitutes the invention.

Further, the storage medium, such as a floppy disk, a hard disk, an optical disk, a magneto-optical disk, CD-ROM, CD-R, a magnetic tape, a non-volatile type memory card, and ROM can be used for providing the program codes.

Furthermore, besides aforesaid functions according to the above embodiments are realized by executing the program codes which are read by a computer, the present invention includes a case where an OS (operating system) or the like working on the computer performs a part or entire processes in accordance with designations of the program codes and realizes functions according to the above embodiments.

Furthermore, the present invention also includes a case where, after the program codes read from the storage medium are written in a function expansion card which is inserted into the computer or in a memory provided in a function expansion unit which is connected to the computer, CPU or the like contained in the function expansion card or unit performs a part or entire process in accordance with designations of the program codes and realizes functions of the above embodiments.

As many apparently widely different embodiments of the present invention can be made without departing from the spirit and scope thereof, it is to be understood that the invention is not limited to the specific embodiments thereof except as defined in the claims.

What is claimed is:

1. A display control apparatus which inputs frame-unit image data and performs display control, comprising:

conversion means for performing a predetermined conversion processing on the input image data to obtain converted data;

detection means for detecting a change between frames of the input image data;

first output means for outputting data to partially update display based on the change detected by said detection means and the converted data obtained by said conversion means;

switching means for switching the conversion processing of said conversion means; and second output means for, if said switching means switches the conversion processing of said conversion means, outputting data consisting of converted data obtained from conversion processing switched by said switching means, for at least one frame.

2. The display control apparatus according to claim 1, wherein the predetermined conversion processing of said conversion means is γ conversion.

3. The display control apparatus according to claim 2, wherein said switching means switches a γ value used in they conversion.

4. The display control apparatus according to claim 1, further comprising prohibition means for, if said switching means switches the conversion processing, prohibiting use of image data, inputted during at least a frame period in which switchover of the conversion processing has been made.

5. The display control apparatus according to claim 4, wherein if said switch means switches the conversion processing, said prohibition means prohibits said detection means from detecting the change during at least a frame period in which the switchover of the conversion processing has been made.

6. The display control apparatus according to claim 4, wherein if said switch means switches the conversion processing, said prohibition means prohibits output of data for updating using the image data inputted during at least a frame period in which the switchover of the conversion processing has been made.

7. The display control apparatus according to claim 4, further comprising converted-data storage means for storing the converted data obtained by said conversion means, as data to be used by said first output means, for at least one frame, wherein said prohibition means prohibits said converted-data storage means from storing the converted data during at least a frame period in which the switchover of the conversion processing has been made.

8. The display control apparatus according to claim 4, further comprising data storage means for storing data based on the input image data, as data to be used by said detection means, for at least one frame, wherein said prohibition means prohibits said data storage means from storing the data during at least a frame period in which the switchover of the conversion processing has been made.

9. The display control apparatus according to claim 1, wherein switchover of the conversion processing by said switching means is made by manual operation.

10. The display control apparatus according to claim 1, further comprising input means for inputting a signal designating conversion processing to be used by said conversion means, from an external device, wherein switchover of the conversion processing by said switching means is made based on the signal inputted by said input means.

11. The display control apparatus according to claim 1, further comprising input means for inputting a signal designating conversion processing to be used by said conversion means, from a display device to be controlled by said display control apparatus, wherein switchover of the conversion processing by said switching means is made based on the signal inputted by said input means.

12. The display control apparatus according to claim 1, wherein said switching means performs switchover of the conversion processing during a frame period subsequent to a frame in which switching instruction has been detected.

13. A display apparatus which inputs frame-unit image data and displays an image, comprising:

conversion means for performing a predetermined conversion processing on the input image data to obtain converted data;

detection means for detecting a change between frames of the input image data;

first output means for outputting data to partially update display based on the change detected by said detection means and the converted data obtained by said conversion means;

switching means for switching the conversion processing of said conversion means;

second output means for, if said switching means switches the conversion processing of said conversion means, outputting data consisting of converted data obtained from conversion processing switched by said switching means, for at least one frame; and display means for displaying an image based on data outputted by said first output means and said second output means.

14. The display apparatus according to claim 13, wherein the predetermined conversion processing of said conversion means is γ conversion.

15. The display apparatus according to claim 13, wherein said switching means switches a γ value used in the γ conversion.

16. The display apparatus according to claim 13, further comprising prohibition means for, if said switching means switches the conversion processing, prohibiting use of image data, inputted during at least a frame period in which switchover of the conversion processing has been made.

17. The display apparatus according to claim 16, wherein if said switch means switches the conversion processing, said prohibition means prohibits said detection means from detecting the change during at least a frame period in which the switchover of the conversion processing has been made.

18. The display apparatus according to claim 16, wherein if said switch means switches the conversion processing, said prohibition means prohibits output of data for updating using the image data inputted during at least a frame period in which the switchover of the conversion processing has been made.

19. The display apparatus according to claim 16, further comprising converted-data storage means for storing the converted data obtained by said conversion means, as data to be used by said first output means, for at least one frame, wherein said prohibition means prohibits said converted-data storage means from storing the converted data during at least a frame period in which the switchover of the conversion processing has been made.

20. The display apparatus according to claim 16, further comprising data storage means for storing data based on the input image data, as data to be used by said detection means, for at least one frame, wherein said prohibition means prohibits said data storage means from storing the data during at least a frame period in which the switchover of the conversion processing has been made.

21. The display apparatus according to claim 13, wherein switchover of the conversion processing by said switching means is made by manual operation.

22. The display apparatus according to claim 13, further comprising input means for inputting a signal designating conversion processing to be used by said conversion means, from an external device, wherein switchover of the conversion processing by said switching means is made based on the signal inputted by said input means.

23. The display apparatus according to claim 13, wherein said switching means performs switchover of the conversion processing during a frame period subsequent to a frame in which switching instruction has been detected.

24. The display apparatus according to claim 13, wherein said display means comprises a ferroelectric liquid crystal display panel.

25. A display method for inputting frame-unit image data and performing display control, comprising:

a conversion step of performing a predetermined conversion processing on the input image data to obtain converted data;

a detection step of detecting a change between frames of the input image data;

a first output step of outputting data to partially update display based on the change detected at said detection step and the converted data obtained at said conversion step;

a switching step of switching the conversion processing at said conversion step; and a second output step of, if the conversion processing at said conversion step is switched at said switching step, outputting data consisting of converted data obtained from conversion processing switched at said switching step, for at least one frame.

26. The display control method according to claim 25, wherein the predetermined conversion processing at said conversion step is γ conversion.

27. The display control method according to claim 25, wherein a γ value used in they conversion is switched at said switching step.

28. The display control method according to claim 25, further comprising a prohibition step of, if the conversion processing is switched at said switching step, prohibiting use of image data, inputted during at least a frame period in which switchover of the conversion processing has been made.

29. The display control method according to claim 28, wherein if the conversion processing is switched at said switching step, detection of the change at said detection step is prohibited at said prohibition step, during at least a frame period in which the switchover of the conversion processing has been made.

30. The display control method according to claim 28, wherein if the conversion processing is switched at said switching step, output of data for updating using the image data, inputted during at least a frame period in which the switchover of the conversion processing has been made, is prohibited at said prohibition step.

31. The display control method according to claim 28, further comprising a converted-data storage step of storing the converted data obtained at said conversion step, as data to be used at said first output step, for at least one frame, wherein storing the converted data at said converted-data storage step is prohibited at said prohibition step, during at least a frame period in which the switchover of the conversion processing has been made.

32. The display control method according to claim 28, further comprising a data storage step of storing data based on the input image data, as data to be used at said detection step, for at least one frame, wherein storing the data at said data storage step is prohibited at said prohibition step, during at least a frame period in which the switchover of the conversion processing has been made.

33. The display control method according to claim 25, wherein switchover of the conversion processing at said switching step is made by manual operation.

34. The display control method according to claim 25, further comprising an input step of inputting a signal designating conversion processing to be used at said conversion step, from an external device, wherein switchover of the conversion processing at said switching step is made based on the signal inputted at said input step.

35. The display control method according to claim 25, further comprising an input step of inputting a signal designating conversion processing to be used at said conversion step, from a display device to be controlled by said display control method, wherein switchover of the conversion processing at said switching step is made based on the signal inputted at said input step.

36. The display control method according to claim 25, wherein at said switching step, switchover of the conversion processing is performed during a frame period subsequent to a frame in which switching instruction has been detected.

* * * * *

UNITED STATES PATENT AND TRADEMARK OFFICE

CERTIFICATE OF CORRECTION

PATENT NO. : 5,815,135

DATED : September 29, 1998

INVENTOR(S) : Yui et al.

It is certified that error appears in the above-identified patent and that said Letters Patent is hereby corrected as shown below:

In the drawings:

SHEET 2:

FIG. 2, "16 : BUFER" should read --16 : BUFFER--, "REFLESH" should read --REFRESH--, and "15 : BUFER" should read --15 : BUFFER--.

SHEET 5:

FIG. 5, "REFLESH" should read --REFRESH--.

COLUMN 2:

Line 13, "perform-" should read --perform--.
Line 14, ".manual" should read --manual--.

COLUMN 4:

Line 51, "one" should read --in one--.

COLUMN 10:

Line 3, "they" should read --the $\gamma$--.

UNITED STATES PATENT AND TRADEMARK OFFICE

CERTIFICATE OF CORRECTION

PATENT NO. : 5,815,135

DATED : September 29, 1998

INVENTOR(S) : Yui et al.

It is certified that error appears in the above-identified patent and that said Letters Patent is hereby corrected as shown below:

COLUMN 12:

Line 26, "they" should read --the γ--.

Signed and Sealed this

Thirteenth Day of July, 1999

*Attest:*

*Attesting Officer*

Q. TODD DICKINSON

*Acting Commissioner of Patents and Trademarks*